US006126316A

United States Patent [19]

Bannister

[11] Patent Number: 6,126,316

[45] Date of Patent: Oct. 3, 2000

[54] AUTOMATIC SELF-CLOSING VALVE CLOSURE ASSEMBLY FOR VALVE BAGS

[75] Inventor: Roger Bannister, Crossett, Ark.

[73] Assignee: Bemis Company, Inc., Minneapolis, Minn.

[21] Appl. No.: 09/191,856

[22] Filed: Nov. 12, 1998

Related U.S. Application Data

[63] Continuation-in-part of application No. 09/010,861, Jan. 22, 1998, Pat. No. 6,013,018, which is a continuation-in-part of application No. 08/906,463, Aug. 5, 1997, abandoned.

[60] Provisional application No. 60/025,462, Sep. 5, 1996.

[51] Int. Cl.[7] ..... B65D 30/24

[52] U.S. Cl. ..... 383/48; 383/54

[58] Field of Search ..... 383/48, 53, 54, 383/44

[56] References Cited

U.S. PATENT DOCUMENTS

| | | | |
|---|---|---|---|
| 3,191,850 | 6/1965 | Niemeyer | 383/54 X |
| 4,412,645 | 11/1983 | Lepisto | 383/48 |
| 4,759,640 | 7/1988 | Groner | 383/54 X |
| 6,013,018 | 1/2000 | Bannister | 493/102 |

FOREIGN PATENT DOCUMENTS

| | | | |
|---|---|---|---|
| 695443 | 9/1965 | Italy | 383/54 |
| 1357544 | 6/1974 | United Kingdom | 383/54 |

*Primary Examiner*—Jes. F. Pascua
*Attorney, Agent, or Firm*—Lee, Mann, Smith, McWilliams, Sweeney & Ohlson

[57] ABSTRACT

The present invention is a valve bag with a valve assembly that provides closure during and after the filling process, thus preventing unwanted spilling and sifting of the valve bag contents through the valve opening during transporting or moving the bag to a location in which the valve is permanently sealed, and methods for making and filling such a bag. An automatic self-closing valve assembly also is provide that requires no subsequent sealing after the filling process.

15 Claims, 10 Drawing Sheets

AUTOMATIC SELF-CLOSING VALVE CLOSURE ASSEMBLY FOR VALVE BAGS

RELATED APPLICATION

This is a continuation-in-part of application Ser. No. 09/010,861 filed Jan. 22, 1998, now U.S. Pat. No. 6,013,018 which is a continuation-in-part application of application Ser. No. 08/906,463 filed Aug. 5, 1997, now abandoned, claiming the benefit of U.S. Provisional Application Serial No. 60/025,462, filed Sep. 5, 1996.

BACKGROUND OF THE INVENTION

The present invention relates to valve bags that feature a self-closing valve which closes in response to pressure from the contents of the bag after filling. The contents are typically a powdered or granular medium. A valve bag is a container made with one or more tubular plies of material, the material usually being a rigid paper such as kraft paper. Typically, the valve bag ends are formed by cutting and folding the plies, thereby forming flaps on the long sides of the bag end. Flaps are also formed on the short sides of the bag end. The short flaps are folded inward and the long flaps are folded over each other on top of the short flaps, thus forming the end of the bag. These flaps may be glued or bonded together to seal the end of the bag. The bag is usually folded to form corner tucks extending from both short sides of the bag end resulting in a satchel-type rectangular configuration. These corner tucks or gussets may be folded inward from the sides of the bag. When the bag is filled, these corner tucks unfold and cause the bag end, top or bottom, to take the rectangular shape. This type of bag is usually called a satchel bag.

A valve bag is most often a satchel bag which features a channel formed on one of the short sides of the filling end of the bag. This channel is typically a flattened tube which is inserted during bag manufacturing on one side of the bag end before the flaps are folded and sealed together. The channel may also be formed by leaving the two flaps on the long side of the bag end unsealed to the flap on the short side. The channel and the length of the flap on the short side form a passage, which allows access to the interior of the bag for filling it with contents. The folded short side flap may extend further into the bag than the channel, such as that disclosed in Kelley et al., U.S. Pat. No. 5,516,210, thus providing a closure or shutoff for the valve. The valve is closed by the contents of the bag pushing this flap against the sealed long side flaps of the bag end. When the prior art valves are closed, the contents of the bag are supposed to be prevented from sifting out of the channel. Thus, there is no need to immediately heat or sonically seal the bag after it is filled. This allows the bag to be sealed immediately or at another location on the production line in the filling process of the bag user. In another embodiment, having particular suitability to large width satchel-type bags, the valve assembly automatically achieves full closure with no final sealing step required subsequent to filling the bag with product.

The main goal of prior art sealable valve bags has been to prevent the sifting or leakage of the bag contents back through the channel of the valve after filling. This goal was addressed by the initial mechanical closing or sealing of the valve in order to prevent such sifting or leaking. Known sealable valve bags have utilized a valve formed from a flattened tube. This tube usually extends outward from the short side of the bag end in order to provide an adequate length of material for the sealing process. For the final sealing closure, the inner surface of the tube is typically coated with an adhesive or other sealing material, which may be activated by heat, pressure, or ultrasonic means. Other valve bag constructions rely on hot melt glue to provide a final seal to the valve. When the packer is ready, valve bags are filled by means of a filling nozzle which is inserted into the valve channel. When the bag is full, the nozzle is removed and the valve opening is then ready to be finally sealed.

While some of the sifting problems have been prevented by these previously used sealable valve bags, they still have limitations inherent in their structure. Sifting and spillage may yet occur when the filling nozzle is removed. This is partially due to the memory of the rigid valve material after removal of the nozzle. Prior art bags which were to be finally sealed at a remote location down the manufacturing line, distant from the filling point, spilled out product between these two stages of the process. Even valve bags which have had an extended short side flap in order to close off the valve channel, nonetheless have still allowed sifting around the sides of this flap, resulting in spillage through the valve opening during transport to the final sealing station. This spillage also affects the seal quality by contaminating any opposing sealing surfaces prior to the sealing process. Furthermore, since the prior art valve constructions have typically utilized only the plies of the bag to support the valve tube, they have been susceptible to tears or damage during the filling process.

It is therefore an object of the present invention to provide a sealable valve bag assembly, which upon filling, immediately creates a mechanical seal lock along the standard parallel fold lines of a satchel-type bag end at the bag-inward opening of the valve tube, thereby sealing both sides of the valve tube in the fold lines and eliminating any possible channeling of the bag contents through and alongside the valve tube prior to a final sealing step.

In an alternate embodiment, it is a goal of the invention to eliminate a final sealing step whereby the valve assembly automatically reaches full closure upon filling the bag with product.

It is a further object of the present invention to provide a seal tab lock which extends beyond the innermost edge of the short side flap of the bag, thus creating a flap valve which purposely prevents filled product from escaping back out the valve tube before the valve is ultimately sealed by heat, sonic, pressure, adhesive means, or the like.

It is still another object of the present invention to provide a seal tab lock which is attached to the valve bag assembly, but not formed from the valve bag plies, thus adding strength and support to the valve side of the bag end in order to prevent tears or ruptures in the valve area during and after the filling operation.

SUMMARY OF THE INVENTION

The present invention is a valve closure assembly, preferably sonically sealable, for use in valve bags. The valve bag is a container formed from tubular-shaped plies of material, the ends of the bag being formed by cutting the bag material at the corners of the bag end and folding short sides of the bag end inward, thus creating two flaps along long sides of the bag end. A seal tab lock is disposed and affixed on one of the short sides of the bag end where the valve will be located, the seal tab lock also being positioned over the parallel fold lines of the long side flaps of the bag end and extending past both fold lines by an equal length. The seal tab lock is also positioned so that it extends over the inner edge of the longest corner infold of the short side of the bag end. A valve tube is disposed and affixed over the seal tab lock and offset by a predetermined distance so that the seal tab lock extends further into the inner portion of the bag than the inside end of the valve tube. This offset also results in the valve tube extending outwardly from the short side of the bag end. The long side flaps on the bag end are then folded over each other at the parallel fold lines and sealed so that the bag end is formed with the valve tube exposed from one side of the bag end.

Upon filling the bag with the intended product, the seal tab lock, which is affixed to the short side of the bag end before the valve tube is affixed, and also before the long side flaps are folded inward and sealed, forms a barrier around the sides of the inner valve tube end and a mechanical closure for the valve tube inside the bag. The side barrier is formed by extended portions of the seal tab lock inside the bag and along the parallel folds formed by the long side flaps on the bag end. When the long side flaps are folded inward, the extended portions are also folded over, thus creating the seal lock. The offset positioning of the valve tube in relation to the seal tab lock results in the seal tab lock extending further into the bag than the inner valve tube opening, thereby creating a flap valve closure action, which effects a valve tube closure prior to sealing.

In a preferred embodiment of the invention, the width of the seal tab lock equals the width of the valve size specified plus one inch for use with a fill width valve. A seal tab lock may also be specified for a reduced valve by providing a wider seal tab lock. Preferably, the width of the seal tab lock will allow enough material to fold over the valve tube in order to create seal tabs along the sides of the valve tube. The valve tube material is preferably a heavy paper, or other rigid material, which allows for easy insertion of a filling nozzle. The heavy paper also prevents tearing or damage to the valve tube during or after the filling process. The inside surface of the valve tube is preferably pre-coated with a sealable material to allow sealing of the valve tube by heat, sonic, pressure, adhesive means, or an equivalent.

In an alternate related invention, a final sealing step is eliminated. The valve assembly automatically self-closes upon filling the bag with product. A seal lock is used having folded and overlapping paper and thin film plastic layers, or all overlapping paper layers, fully wrapping a reduced width valve tube for large size satchel-type bags.

DETAILED DESCRIPTION OF THE INVENTION

Figure 1:
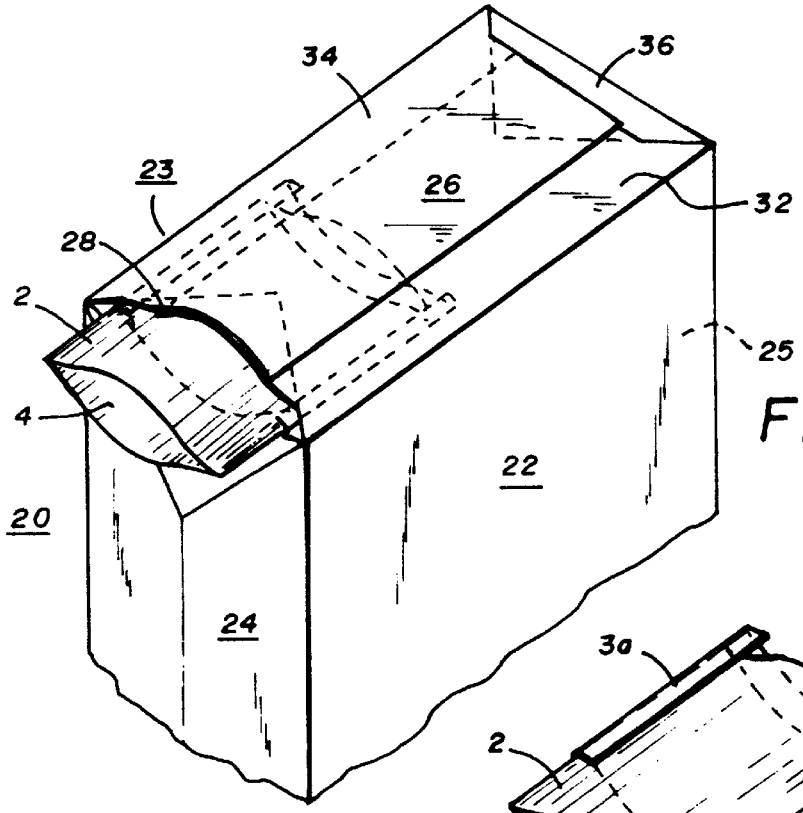
FIG. 1 is a perspective view of a satchel end of an assembled multiple ply valve bag at the bag end having the valve assembly.

A typical valve bag 20 has a tubular configuration with long sides 22 and 23, and short sides 24 and 25, as shown in FIG. 1. For simplicity of illustration, only one bag end 26 with a valve assembly 10 is shown. After final assembly of the valve bag 20, a valve tube 2 extends from the valve side 28 of the bag end 26 and provides a valve channel 4 in order to access the inside of the valve bag 20. The valve bag 20 is usually constructed with one or more paper plies A, B, and C, and is provided with a step pattern 60 at the bag end 26 as illustrated in FIG. 2.

Figure 2:
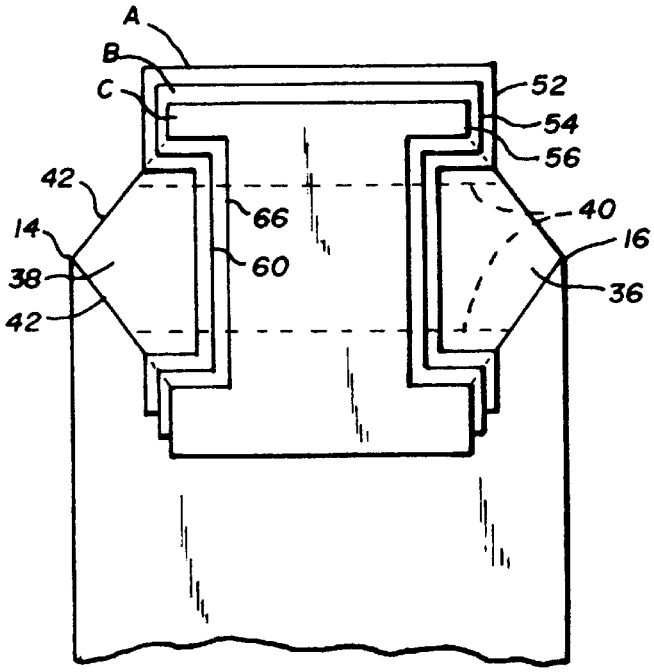
FIG. 2 is a plan view of the unassembled valve bag end of FIG. 1 showing the long side flaps of the multiple bag plies formed by cutting the corners of the valve bag and the short side flaps of the multiple bag plies folded inwardly.

The first step of the sonic valve bag construction depicted in FIG. 2 is to cut the paper plies A, B, and C of the bag end 26, thus creating cut lines 52, 54, and 56. The step pattern 60 is exposed at the short sides 24 and 25 of the bag end 26 by cutting away a portion of the bag ply A, also as shown in FIG. 2. Short side flaps 36 and 38 are folded inward, creating fold lines 42 at the short sides 24 and 25 of the bag end 26 and also creating flaps 32 and 34 along the long sides 22 and 23 of the bag end 26. Parallel fold lines 40 are created to allow the flaps 32 and 34 to fold inward during the final assembly. This construction creates a known type of satchel bag end with outwardly folded gussets 14 and 16 formed by the fold lines 42 at the short sides 24 and 25 of the bag end 26. When the bag 20 is filled with contents, gussets 14 and 16 unfold and cause the bag end 26 to take a rectangular shape.

Figure 3:
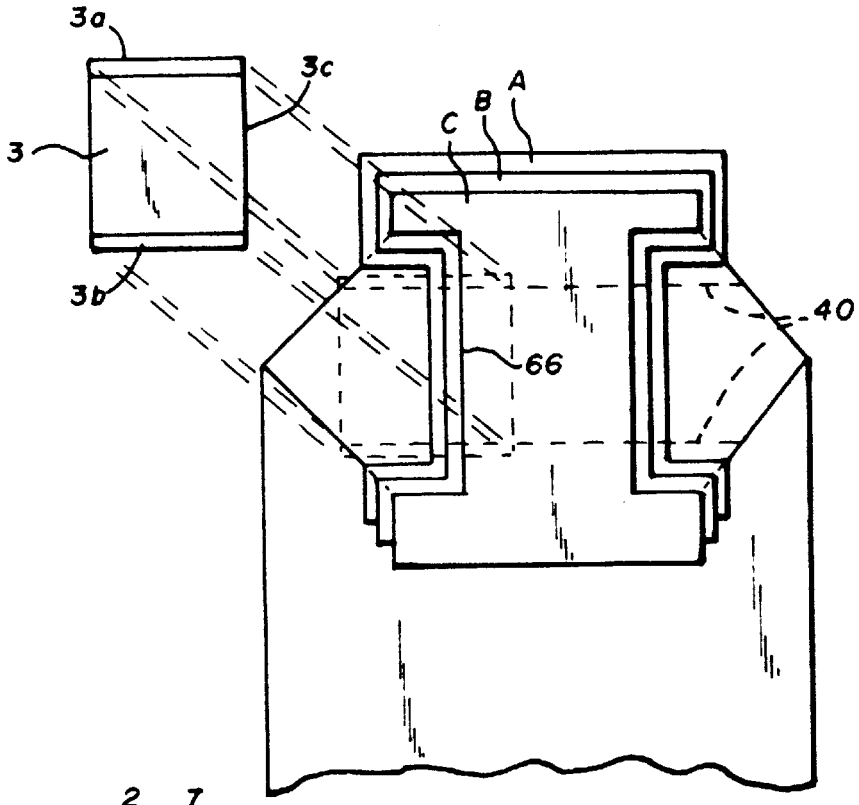
FIG. 3 is a plan view of the bag end having the valve assembly showing the assembly placement step for the seal tab lock shown exploded away and in dashed lines with respect to the flaps and parallel fold lines of the bag end.

A seal tab lock 3 is disposed on the short side flap 38 as shown in FIG. 3 and is centered upon the fold lines 40, so that an equal length of the seal tab lock 3 extends over each fold line 40, thus creating folded-over tab locks 3*a* and 3*b*. The seal tab lock 3 is further disposed so that an inner edge 3*c* extends over an innermost edge 66 of the short side flap 38 by a predetermined distance, this distance being about two inches in the preferred embodiment. This inward extension distance can be longer if the filling nozzle opening 82 shown in FIG. 10 allows, but preferably is no less than about one and one half inches. The seal tab lock 3 in the preferred embodiment is a 50 pound super (high) performance kraft (SPK) paper. The seal tab lock 3 may be formed from the same material as the plies of the bag 20.

Figure 4:
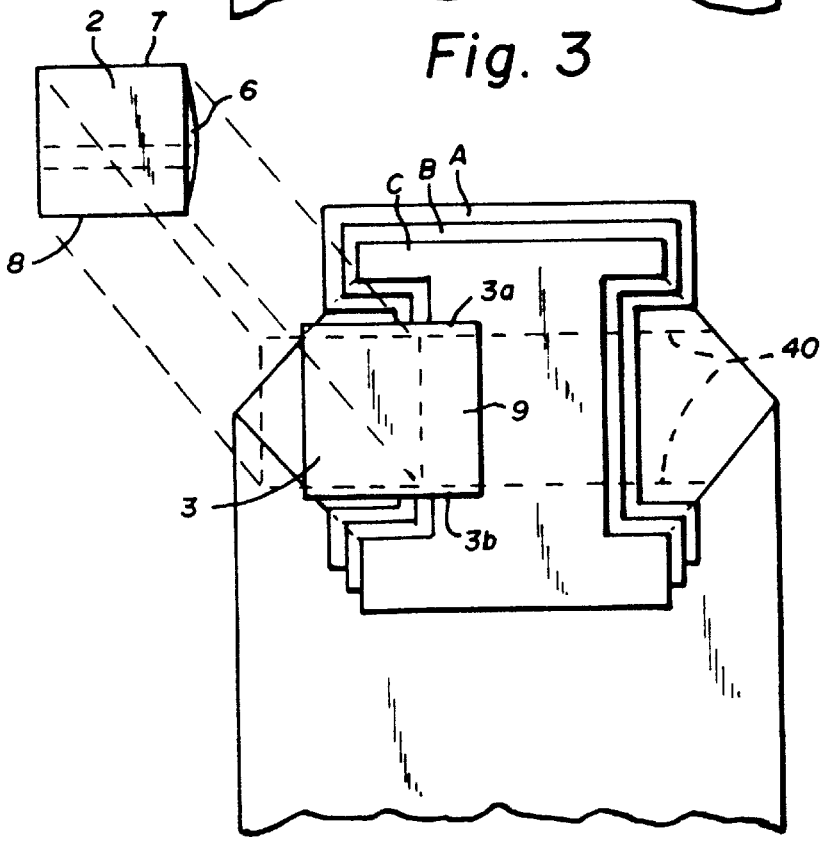
FIG. 4 is a plan view of the bag end having the valve assembly showing the assembly placement step for the sonic valve tube shown exploded away and in dashed lines with respect to the seal tab lock and the parallel fold lines of the bag end.

A valve tube 2 is then disposed on the seal tab lock 3 and positioned such that the valve tube 2 is offset toward the valve side 28 by a predetermined distance, allowing the inner portion of the seal tab lock 3 to extend past the inner opening 6 of the valve tube 2 and creating a flap valve 9 portion of the seal tab lock 3, as shown in FIG. 4. The offset distance in the preferred embodiment is one quarter inch towards the valve side 28 from the innermost edge 66 of the short side flap 38, plus or minus one quarter inch. The length of the valve tube 2 is dictated by the satchel size of the valve bag 20 and the sealing equipment requirements. The material of the valve tube 2 is preferably a heavy paper, or other rigid material, such as a 70 pound natural kraft paper, or equivalent. An example of a suitable alternative material for the valve tube 2 is 60 pound bleached white kraft paper. The invention is not limited to forming the valve tube 2 or the seal tab lock 3 only from paper as other suitable materials are envisioned, including plastic polymers.

An inside surface 1 of the valve tube 2 is coated with a special blend of coatings for use in the sealing process. The preferred coating for ultrasonic sealing is polyethylene applied in the proportion of about 40 to 50 pounds of coating per ream of paper. The preferred formulation for the polyethylene coating has the proportion of about 40%±5% by weight of low density polyethylene with metallocene and about 60%±5% by weight of high density polyethylene. The coating may also include an anti-static ingredient. An example of a suitable alternative coating is #1652 slip additive resin, sold under the brand name SURLYN by E. I. DuPont deNemours Chemical Company. To prevent curling, the outer surface of the seal tube may be coated with an anti-curling coating. Other coatings may be used for different sealing processes. The valve tube 2 may be coated with other equivalent sealing compositions that may be alternatively sealed through heat, adhesive, or pressure means, as would be understood by those skilled in the art.

Figure 5:
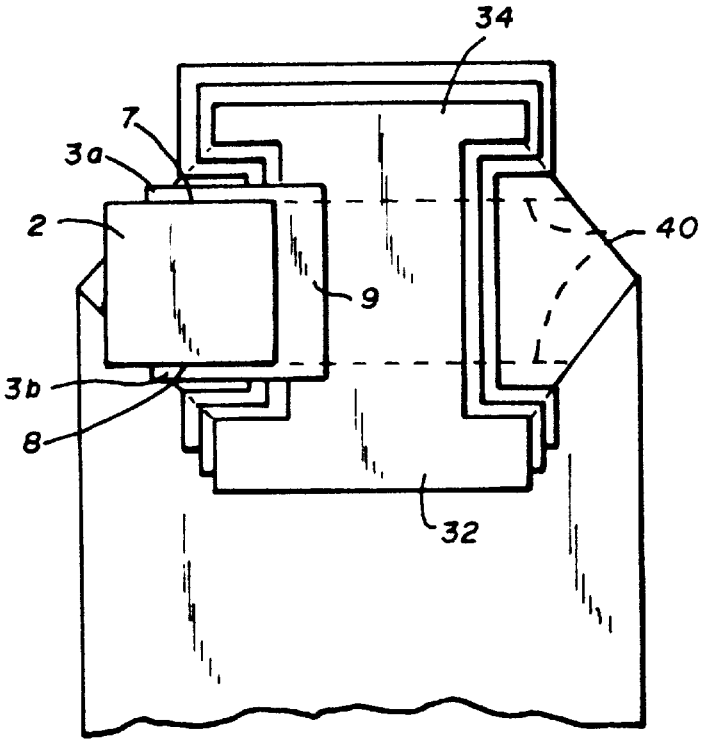
FIG. 5 is a plan view of the bag end having the valve assembly showing a full width valve assembly shown prior to the folding of the long side flaps of the bag end.

FIG. 5 shows the seal tab lock 3 and the valve tube 2 affixed to the short side flap 38 of the bag end 26.

Figure 6:
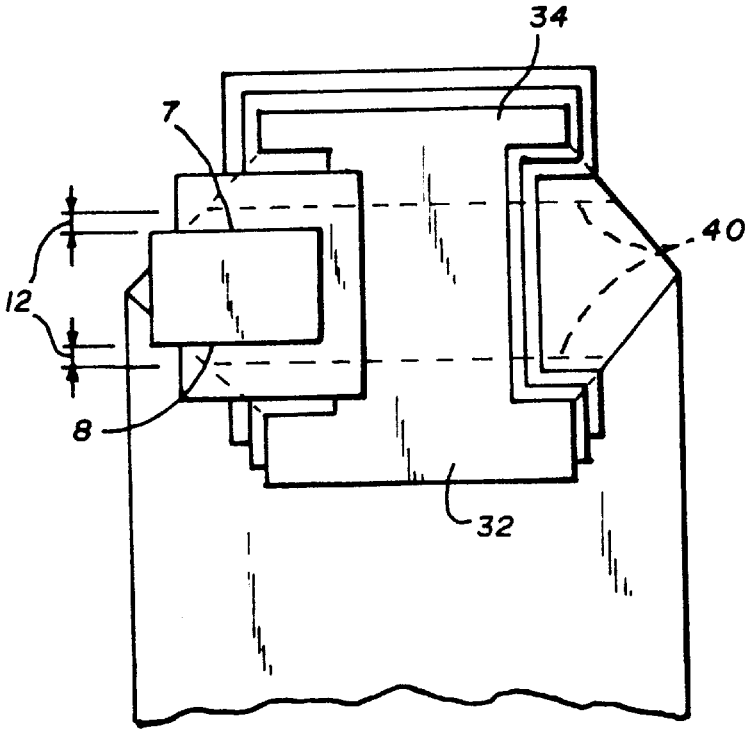
FIG. 6 is a plan view of the bag end similar to FIG. 5 and having a valve assembly in an alternate embodiment for a reduced size valve assembly shown prior to the folding of the long side flaps of the bag end.

FIG. 6 shows the seal tab lock 3 and the valve tube 2 formed in different dimensions, affixed to the short side flap 38 of the bag end 26, thereby forming a reduced size alternate embodiment of the valve assembly 10. The width of the seal tab lock 3 for a full width valve in the exemplary embodiment is determined by adding one inch to the width of the valve tube 2. For standard 40–60 pound capacity paper valve bags, the full width valve manufacturing range is from about three to about nine inches. The width of the seal tab lock 3 for a reduced valve in the disclosed embodiment is determined by adding the width of the bag end 26 to the difference between the width of the bag end 26 and the width of the specified reduced valve tube 2, plus one inch. The extra width in this formula is for the purpose of providing enough material for the seal tab lock 3 to cover widest gaps 12 between sides 7 and 8 of the valve tube 2 and the parallel fold lines 40, as shown in FIG. 6. The reduced valves have a manufacturing range from about three to about eight and three quarter inches for the disclosed alternate embodiment.

Figure 1A:
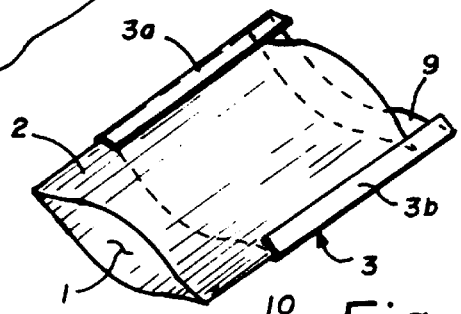
FIG. 1A is a perspective view showing the valve assembly removed from the valve bag.

In the final steps of assembly, the flap 32 is folded inward over the valve tube 2 and the flap 34 is folded over the flap 32 along the fold lines 40, thereby resulting in the tab locks 3*a* and 3*b* of the seal tab lock 3 being folded around and on top of the valve tube 2, as shown in FIG. 1. FIG. 1A shows an isolated view of the assembled valve tube 2 and seal tab lock 3 showing the tab locks 3*a* and 3*b* of the seal tab lock 3 folded around the valve tube 2. In the preferred embodiment, the tab locks 3*a* and 3*b* are integrally joined to the side edges of the seal tab lock 3 and wrap around or over the top of the valve tube 2 for one half inch margins along each side. This provides a complete seal under the valve tube 2 and along the parallel fold lines 40, leaving no channel for the contents to leak out. The flap 34 is then sealed to the flap 32, preferably by pasting, as is known in the bag-making arts, to complete the assembly. The tab locks 3*a* and 3*b* create a seal around the inner opening of the valve tube 2 which, along with the flap valve 9, prevent outward channeling or sifting of the contents of the valve bag 20 during and after the filling process.

Figure 7:
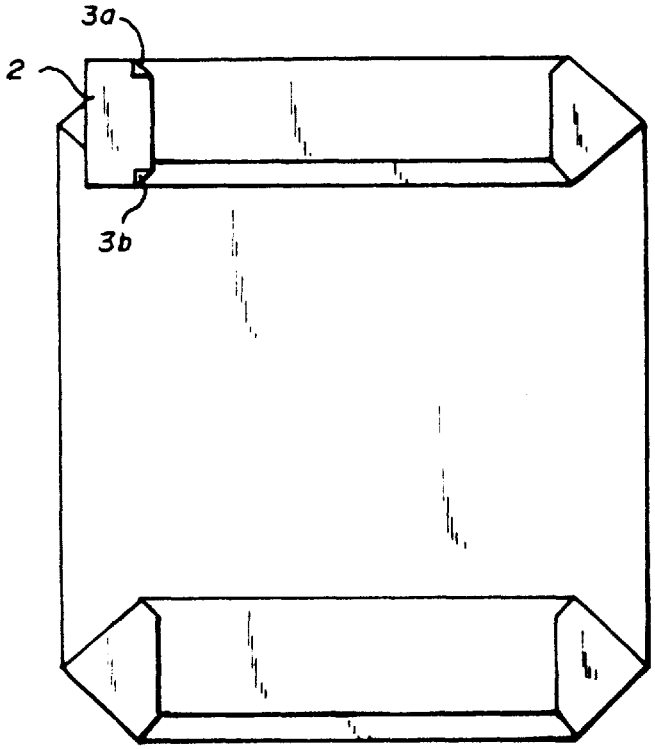
FIG. 7 is a plan view of an entire assembled valve bag with a fall width valve assembly.
Figure 8:
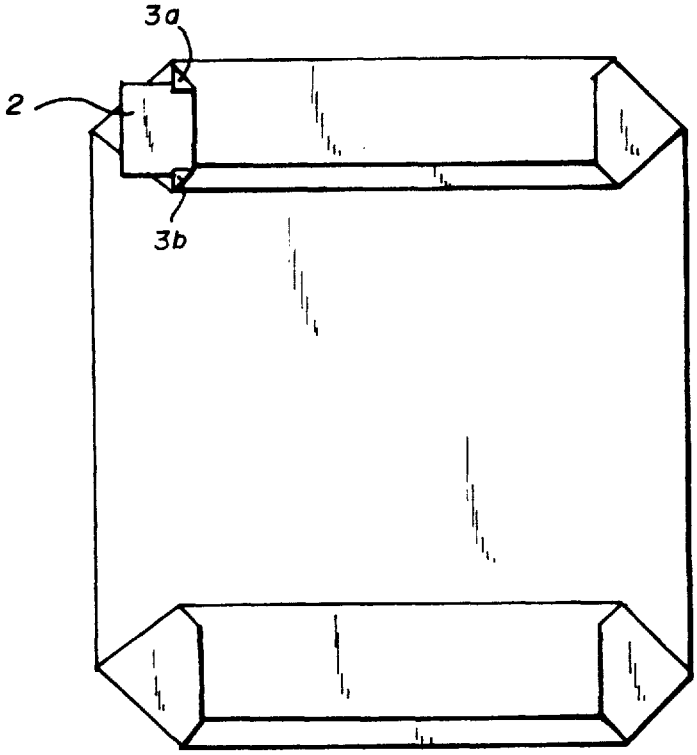
FIG. 8 is a plan view of an entire assembled valve bag with a reduced width valve assembly.

FIG. 7 and FIG. 8 are plan views of the preferred embodiments for the final assemblies of the fall width valve version and the alternate reduced valve version of the valve bag 20, respectively.

Figure 9:
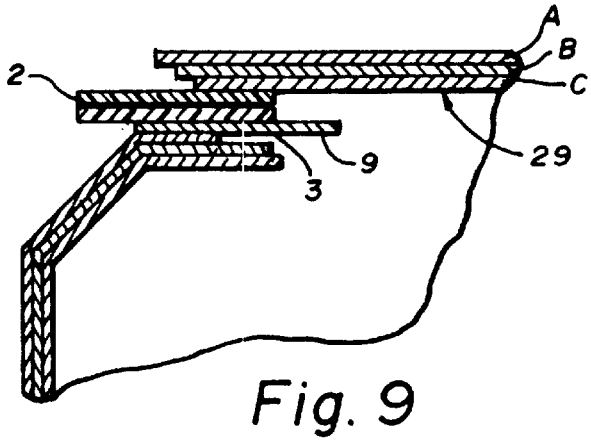
FIG. 9 is a cross-sectional side view of the bag end at the valve assembly before filling.
Figure 10:
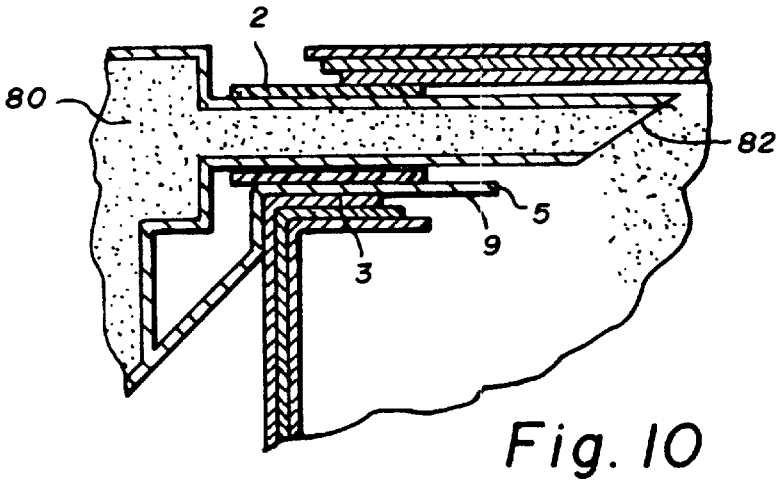
FIG. 10 is a cross-sectional side view of the bag end at the valve assembly during filling by the filling nozzle inserted into the valve.

FIG. 9 is a vertical cross-section taken at the valve side 28 of an assembled empty valve bag 20 ready to be filled. The cross-section reveals the paper plies A, B, and C of the valve bag 20, however the invention is not limited to bags having three plies. The valve tube 2 is shown in a closed but unsealed position with the flap valve 9 of the seal tab lock 3 in an open position. The valve bag 20 is filled by inserting a filling nozzle 80 into the valve channel 4 of the valve tube 2, expanding it open, as shown in FIG. 10. The filling nozzle 80 extends past both the inner opening 6 of the valve tube 2 and an inner edge 5 of the flap valve 9. The valve bag 20 is then filled with contents 100, which would typically be a granular, powdered, or comminuted product, such as dry powdered milk. As the contents 100 inside the valve bag 20 reach the filling nozzle 80, they push flap valve 9 towards the inner surface of the bag end 26. When filling is complete and the filling nozzle 80 is removed, the pressure from the contents 100 of the valve bag 20 forces the flap valve 9 and the tab locks 3*a* and 3*b* against the inner surface 29 of the bag end 26, thereby providing a mechanical closure or shutoff of the inner opening 6 of the valve tube 2. The valve tube 2 is also flattened against the inner surface 29 of the bag end 26 from the pressure of the contents. When the filling nozzle 80 is removed, the tab locks 3*a* and 3*b* of the flap valve 9 prevent the contents from channeling or leaking around the flap valve 9 and sifting back outwardly of the valve channel 4 of the valve tube 2, thus providing an effective closure between the sides 7 and 8 of the valve tube 2 and the inside of the valve bag 20 prior to final sealing of the valve tube 2.

Figure 11:
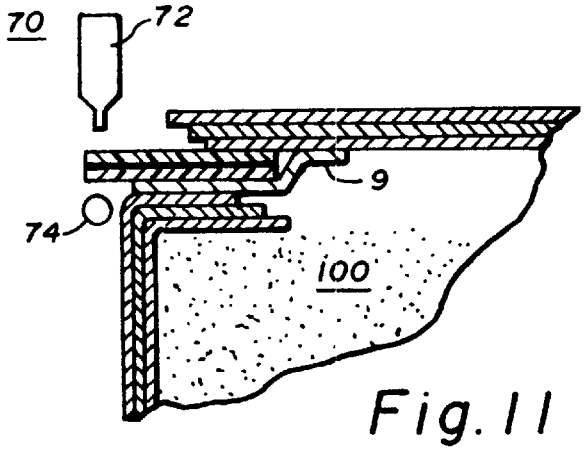
FIG. 11 is a cross-sectional side view of the bag end at the valve assembly showing a filled valve bag and sonic sealing apparatus for sealing the valve closed.

In the disclosed embodiment, the final sealing is illustrated in FIG. 11 and comprises a sonic sealing process performed by a sealing apparatus 70 located on the manufacturing line. The valve bag 20 can be transported to the sealing apparatus 70 via a conveyor system. Sifting and spillage of the contents of valve bag 20 are prevented during the transfer to the sealing apparatus by the function of the tab locks 3*a* and 3*b* and the flap valve 9 as described. The prevention of such spillage allows bags from several filling lines to be transported to distant sealing apparatus stations or other handling procedures. This eliminates the requirement of having a sealing apparatus on each filling line. The sonic sealing of the valve bag 20 may be performed by a typical sealing apparatus 70, such as generator head 72 and anvil 74 shown in FIG. 11. The valve tube 2 extends outwardly from the valve side 28 allowing ample material for the valve tube 2 to be sealed by the sealing apparatus 70 alongside the valve bag 20, as also depicted in FIG. 11.

Figure 12:
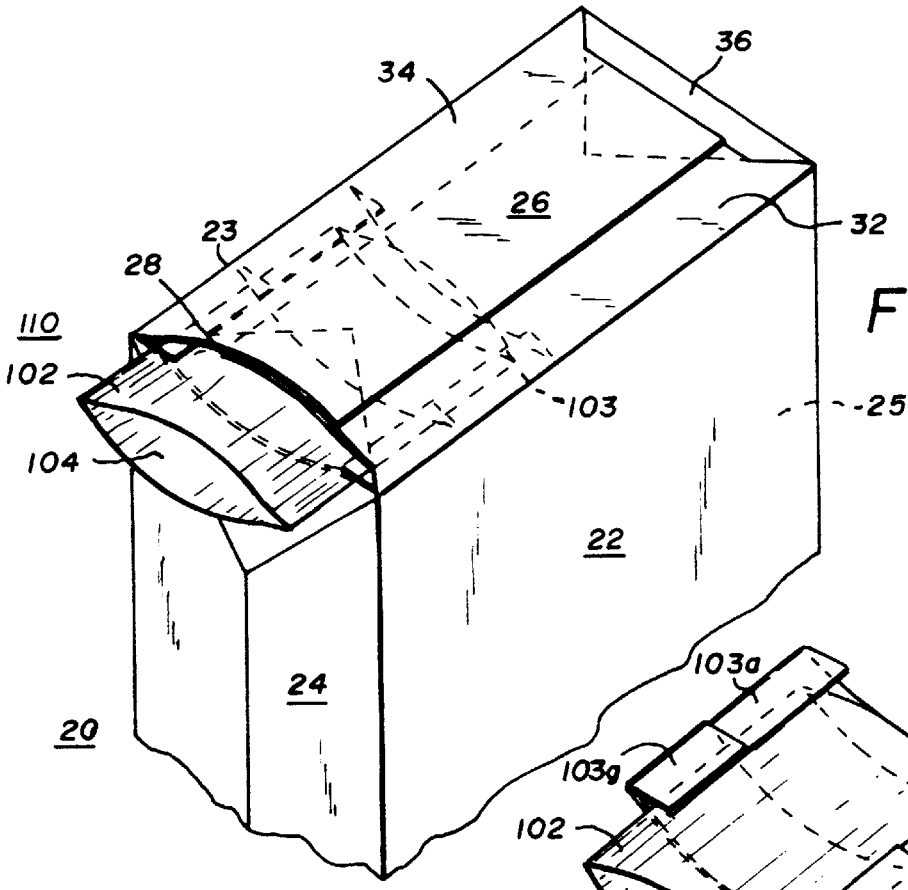
FIG. 12 is a perspective view of a satchel end of an assembled multiple ply valve bag at the bag end having an alternate embodiment of the valve assembly.
Figure 12A:
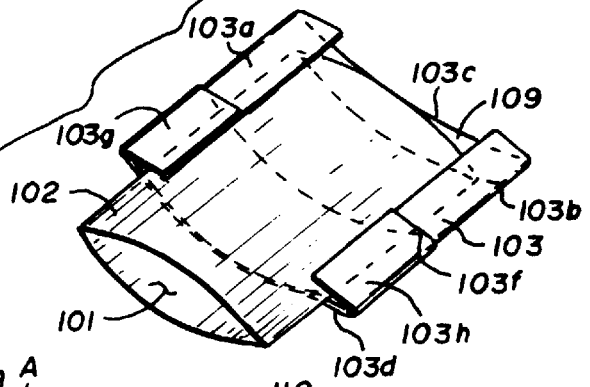
FIG. 12A is a perspective view showing the alternate embodiment of the valve assembly of FIG. 12 removed from the valve bag.
Figure 13:
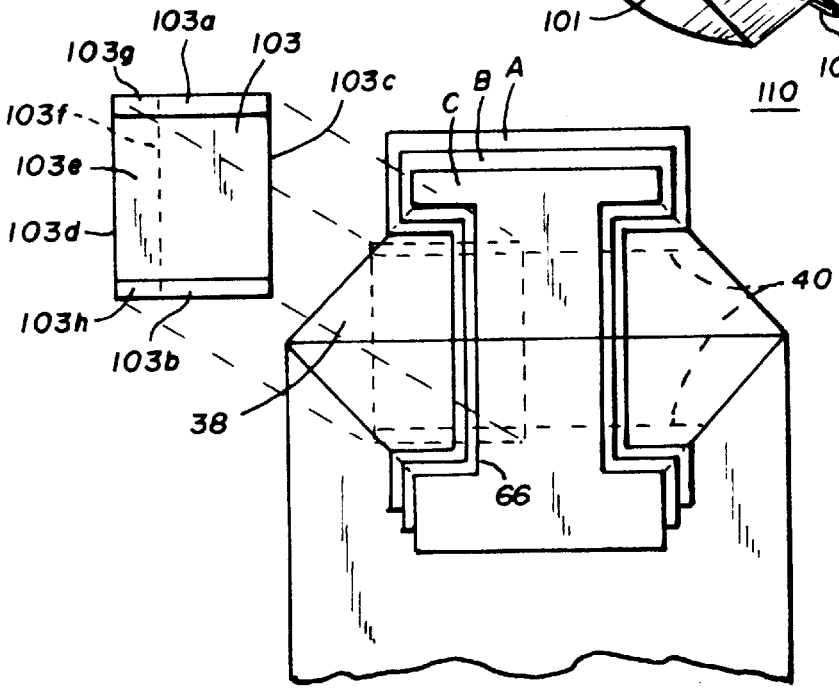
FIG. 13 is a plan view of the bag end having the alternate embodiment of the valve assembly of FIG. 12 showing the assembly placement step for the seal tab lock shown exploded away and in dashed lines with respect to the flaps and parallel fold lines of the bag end.

FIG. 12 shows the assembled valve bag 20 having an alternate embodiment valve assembly 110. FIG. 12A is an isolated view of the valve assembly 110 showing tab locks 103*a*, 103*b*, 103*g*, and 103*h* folded around a valve tube 102. In this embodiment, a seal tab lock 103 is folded under itself along an outside edge 103*d* of the seal tab lock 103 prior to being disposed on the bag 20, thus forming folded portion 103*e* and leading edge 103*f*, as shown in FIG. 13. The folded portion 103*e* and the tab locks 103*g* and 103*h* provide a second, or double, barrier to prevent sifting of material between the folded flaps 32 and 34 of the valve bag 20 and the seal tab locks 103*a* and 103*b* of the valve assembly 110, as well as possible sifting between the seal tab lock 103 and the short side flap 38. The tab locks 103*g* and 103*h* of the folded portion 103*e* also provide added strength to the tab locks 103*a* and 103*b* in order to help prevent tearing during the filling and sealing process.

Figure 14:
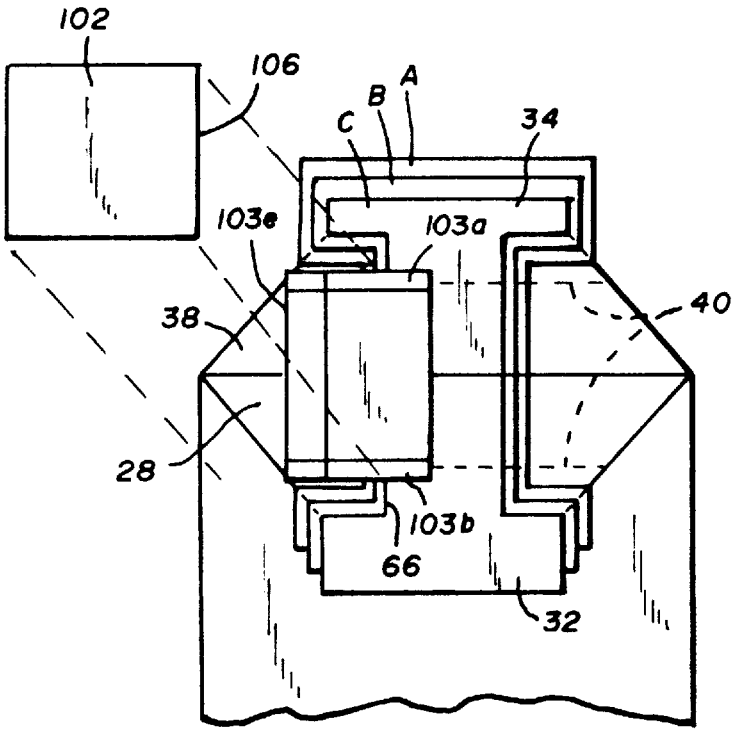
FIG. 14 is a plan view of the bag end having the alternate embodiment of the valve assembly of FIG. 12 showing the assembly placement step for the sonic valve tube shown exploded away and in dashed lines with respect to the seal tab lock and the parallel fold lines of the bag end.
Figure 15:
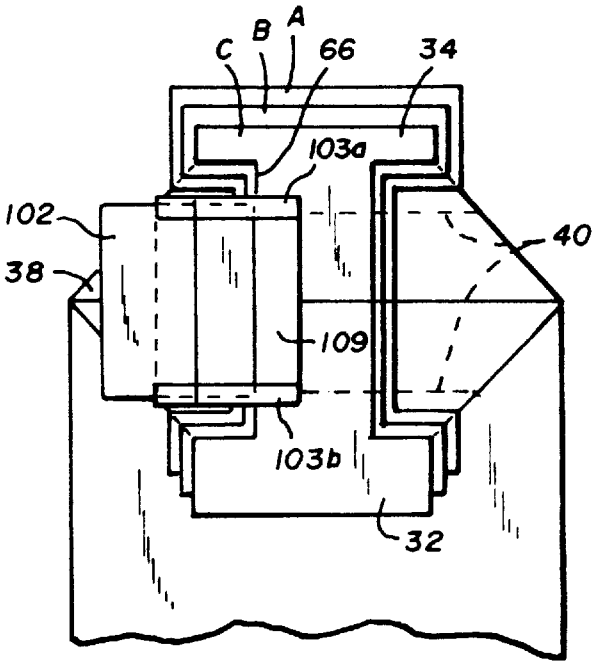
FIG. 15 is a plan view of the bag end having the alternate embodiment of the valve assembly of FIG. 12 showing the valve assembly prior to the folding of the long side flaps of the bag end.

The valve assembly 110 is assembled and attached to the valve bag 20 in much the same way as the other valve assemblies disclosed herein. The seal tab lock 103 with folded portion 103*e* is disposed on the short side flap 38 and is centered upon the fold lines 40, so that an equal length of the seal tab lock 103 extends over each fold line 40, thus creating folded-over tab locks 103*a*, 103*b*, 103*g*, and 103*h*, as shown in FIG. 13. The seal tab lock 103 is further disposed so that an inner edge 103*c* extends over an innermost edge 66 of the short side flap 38 by a predetermined distance, this distance being about two inches in the preferred embodiment. This inward extension distance can be longer if the filling nozzle opening 82 shown in FIG. 10 allows, but preferably is no less than about one and one half inches. The valve tube 102 is then disposed on the seal tab lock 103 and positioned such that the valve tube 102 is offset toward the valve side 28 by a predetermined distance, allowing the inner portion of the seal tab lock 103 to extend past the inner opening 106 of the valve tube 102 and creating a flap valve 109 portion of the seal tab lock 103, as shown in FIGS. 12A, 14 and 15.

Figure 16:
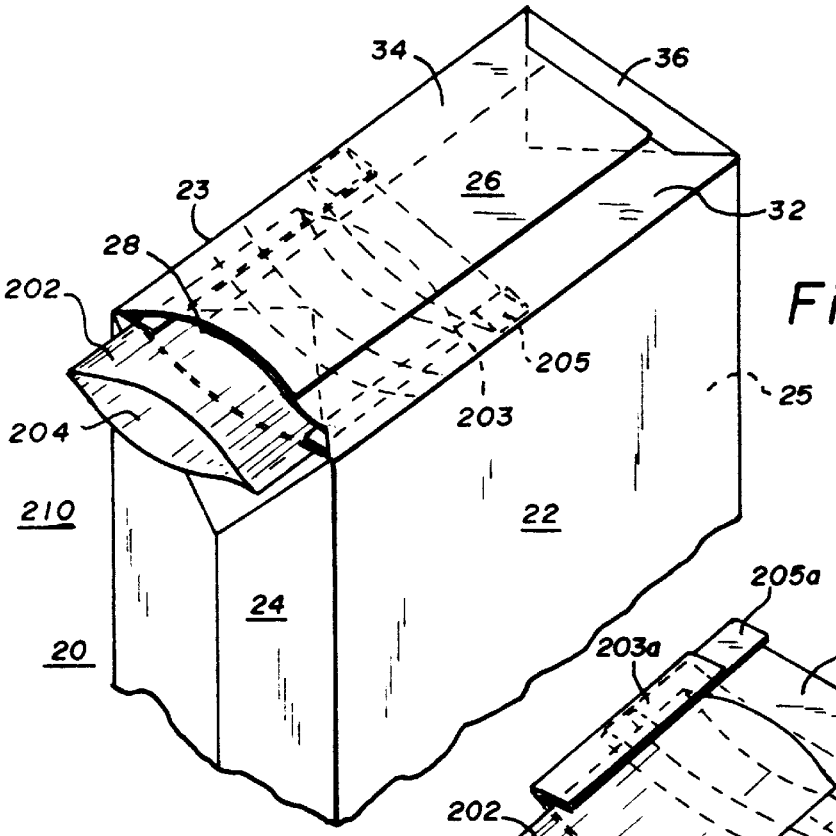
FIG. 16 is a perspective view of a satchel end of an assembled multiple ply valve bag at the bag end having another alternate embodiment of the valve assembly.
Figure 16A:
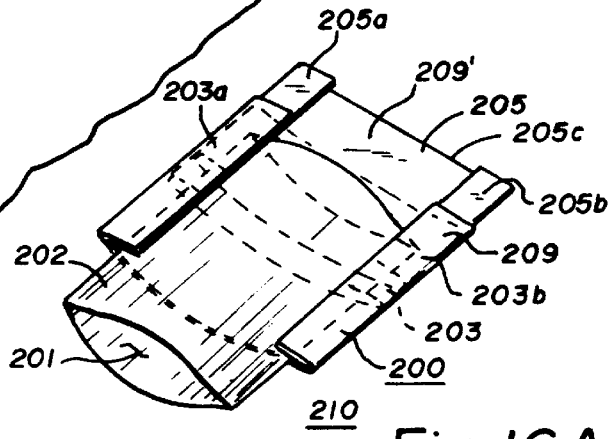
FIG. 16A is a perspective view showing the alternate embodiment of the valve assembly of FIG. 16 removed from the valve bag.
Figure 17:
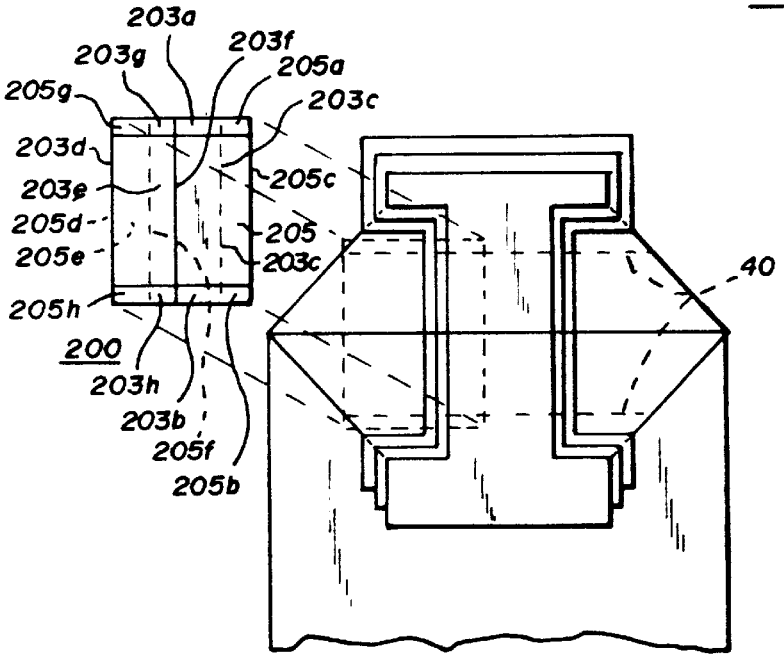
FIG. 17 is a plan view of the bag end having the alternate embodiment of the valve assembly of FIG. 16 showing the assembly placement step for the seal tab lock shown exploded away and in dashed lines with respect to the flaps and parallel fold lines of the bag end.

FIG. 16 shows the assembled valve bag 20 having yet another alternate embodiment valve assembly 210. The valve assembly 210 utilizes a two-piece seal tab lock configuration 200 consisting of a main layer 203, typically made of paper, and an offset layer 205, typically made of a thin plastic film. The main layer 203 and the offset layer 205 of the two-piece seal tab lock 200 have tab locks 203*a*, 203*b* and 205*a*, 205*b*, respectively, folded around a valve tube 202 in FIG. 16A. FIG. 17 further shows the main layer 203 and the offset layer 205 to additionally have tab locks 203*g*, 203*h*, and 205*g*, 205*h*, respectively, of the two-piece seal tab lock 200. In this embodiment, the offset layer 205 is positioned such that an inner edge 205*c* of the offset layer 205 overlaps an inner edge 203*c* of the main layer 203 of the two-piece seal tab lock 200. This overlap creates a two-layer flap valve 209 up to the inner edge 203*c* and a single layer therepast at 209' comprising the offset layer 205 alone. Typically the offset layer 205 is made of a thin plastic film which provides aid in sealing off the valve when product pressure forces the flap valve 209 and 209' closed. When filling is complete, the pressure from the contents of the valve bag 20 forces the flap valve 209 and 209' against the inner surface of the bag end 26, thereby providing a mechanical closure or shutoff of the inner opening 206 of the valve tube 202. The thin plastic film of the offset layer 205 is very limp and provides for a well-sealed shutoff.

Both the offset layer 205 and the main layer 203 are folded over along their outside edges 203*d* and 205*d* prior to being disposed on the valve bag 20, thus forming folded portions 203*e* and 205*e*, and leading edges 203*f* and 205*f*, as shown in FIG. 17. These portions are first folded over the top of the two-layer seal tab lock 200, unlike the seal tab lock 110 in FIG. 12A where the folded portion 103*e* is first folded under the tab lock 110. Thus, the folded portion 205*e* of the thin plastic film is captured by the folded portion 203*e* of paper. The folded portions 203*e* and 205*e* and the tab locks 203*g*, 203*h*, 205*g*, and 205*h* provide a second, or double, barrier to prevent sifting of material between the folded flaps 32 and 34 of the valve bag 20 and the tab locks 203*a*, 203*b*, 205*a*, and 205*b* of the valve assembly 210, as well as preventing sifting between the seal tab lock 203 and the short side flap 38. The tab locks 203*g*, 203*h*, 205*g*, and 205*h* of the folded portions 203*e* and 205*e* also provide added strength to the tab locks 203*a*, 203*b*, 205*a*, and 205*b* in order to help prevent tearing during the filling and sealing process.

Figure 18:
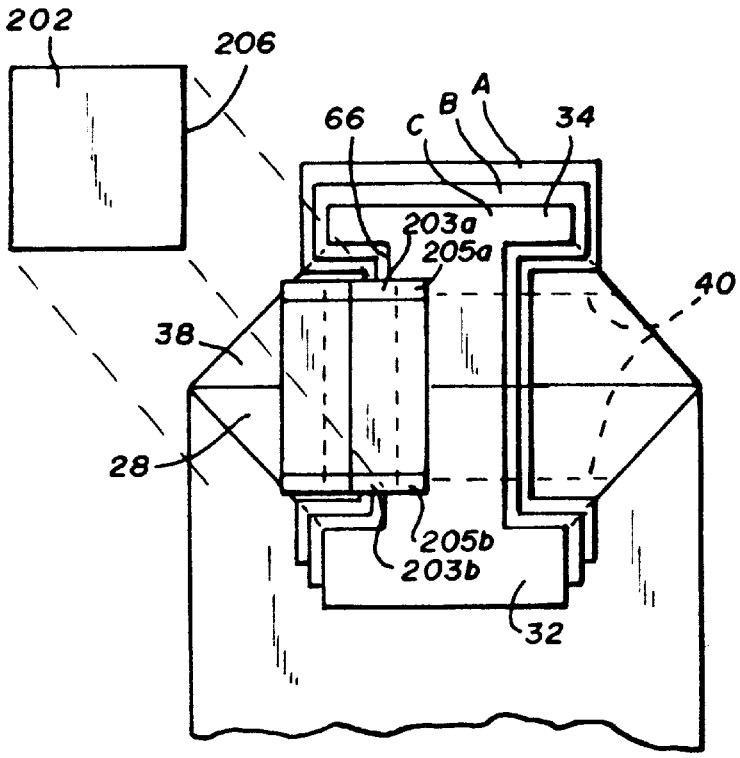
FIG. 18 is a plan view of the bag end having the alternate embodiment of the valve assembly of FIG. 16 showing the assembly placement step for the sonic valve tube shown exploded away and in dashed lines with respect to the seal tab lock and the parallel fold lines of the bag end.
Figure 19:
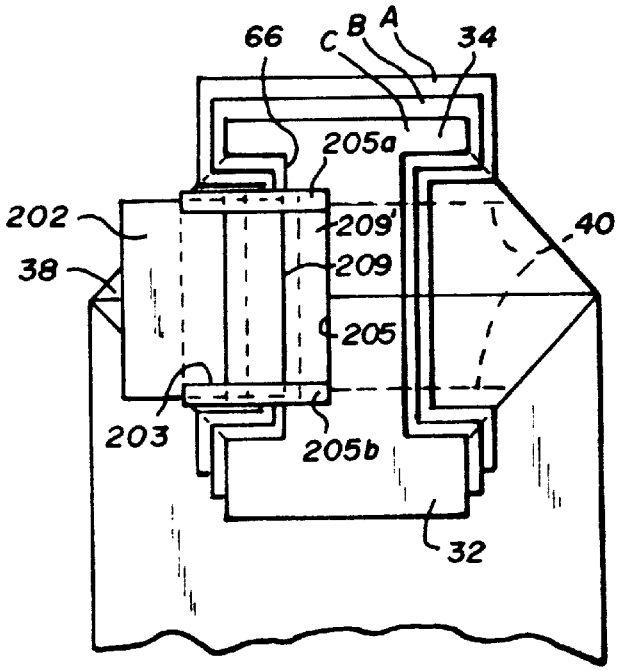
FIG. 19 is a plan view of the bag end having the alternate embodiment of the valve assembly of FIG. 16 showing the valve assembly prior to the folding of the long side flaps of the bag end.

The two-piece seal tab lock 200 with the folded portions 203*e* and 205*e* is disposed on the short side flap 38 as shown in FIG. 17 and is centered upon the fold lines 40, so that an equal length of the two-piece seal tab lock configuration 200 extends over each fold line 40, thus creating the folded-over tab locks 203*a*, 203*b*, 203*g*, 203*h*, 205*a*, 205*b*, 205*g*, and 205*h*. The two-piece seal tab lock 200 is further disposed so that an inner edge 205*c* extends over an innermost edge 66 of the short side flap 38 by a predetermined distance, this distance being about two inches in the preferred embodiment. This inward extension distance can be longer if the filling nozzle opening 82 shown in FIG. 10 allows, but preferably is no less than about one and one half inches. The valve tube 202 is then disposed on the two-piece seal tab lock 200 and positioned such that the valve tube 202 is offset toward the valve side 28 by a predetermined distance, allowing the inner portion of the two-piece seal tab lock 200 to extend past the inner opening 206 of the valve tube 202, thus forming the two-piece flap valve 209, as shown in FIGS. 16A, 18 and 19.

Figure 20:
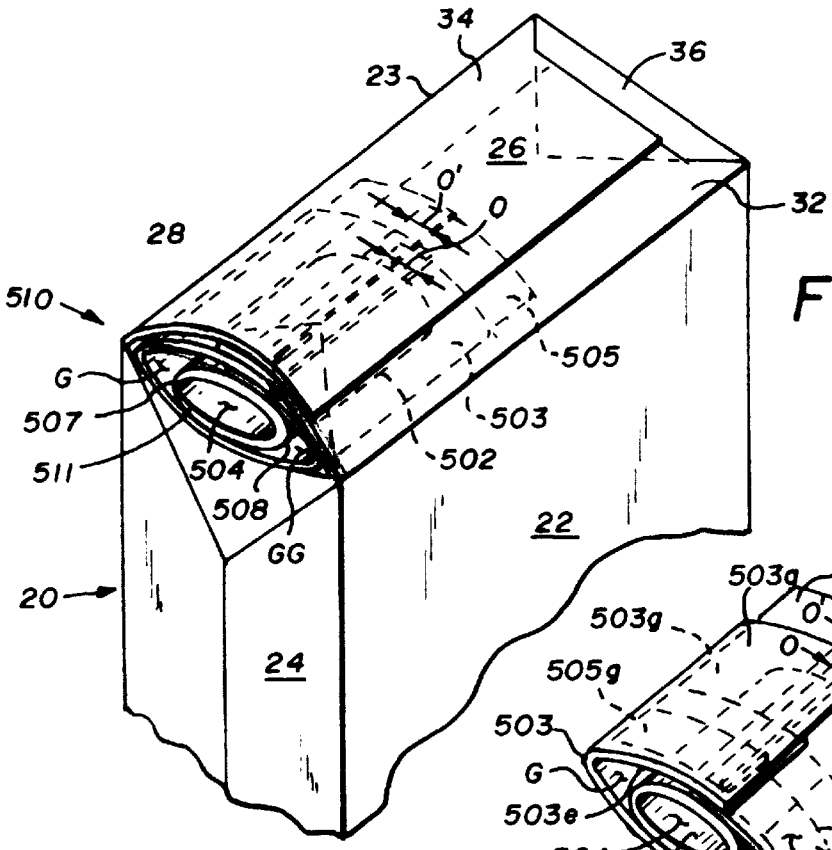
FIG. 20 is a perspective view of a satchel end of an assembled multiple ply valve bag at the bag end having another alternate embodiment of the valve assembly.
Figure 20A:
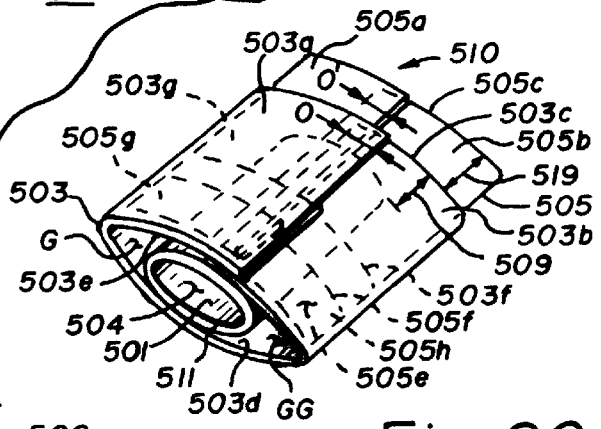
FIG. 20A is a perspective view showing the alternate embodiment of the valve assembly of FIG. 20 removed from the valve bag.
Figure 20B:
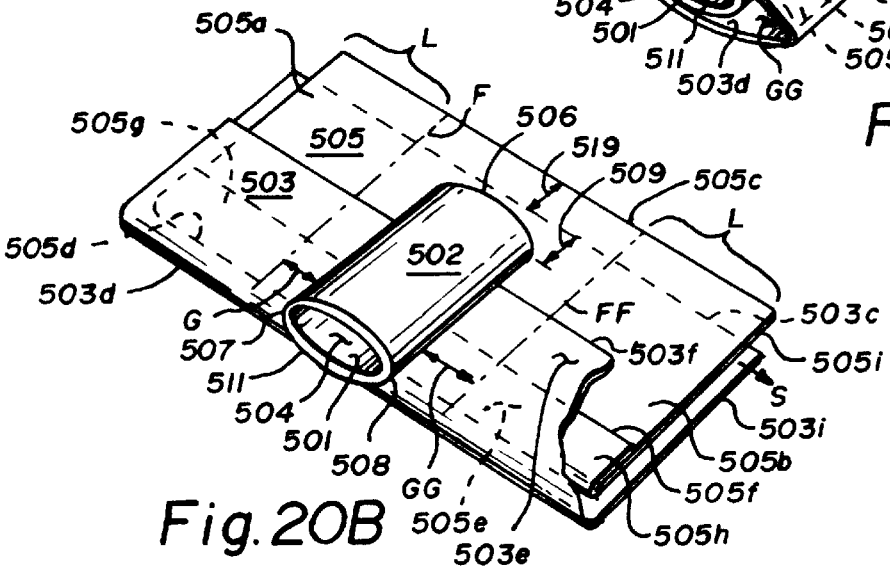
FIG. 20B is an exploded view of the alternate embodiment of the valve assembly of FIG. 20.

FIGS. 20, 20A and 20B illustrate a related invention in a preferred embodiment thereof. Typically in the industry, large width satchel-type bags have been made with reduced valve tube sizes, such as for satchel bottom standard widths of from about six to nine inches. A common size large width satchel-type bag has a nominal width of eight inches. The utilization of a less than full width valve tube provides for a cost savings in material. Because this smaller valve tube does not extend fully across the width of the bag, gaps between the valve tube and sides of the bag and flap valves create the danger of tearing or rupturing the valve assembly during filling and handling. Attempts at providing a reduced valve tube also have utilized thin polyethylene film closure flaps, but these too create problems involving bag rupturing and splitting, because there is little strength between the reduced valve tube and the fold lines of the satchel bottom, such as at lines 40 previously described in reference to FIGS. 1–16.

In addition to the reduction of costs by using a reduced valve tube, the industry has sought to further eliminate costs for sealing large size satchel bags. The utilization of a sonic sealing valve tube, such as shown in FIG. 6 above, while effective for its intended purposes, adds cost in terms of providing a coating to the interior of the valve tube with a sonic sealable material, as described above, requiring a further sealing step, and also in regard to the additional material for the valve tube that has to project bag-outwardly for the sealer to seal, i.e., the extension of valve tube 2 outward of the bag side 28, as shown in FIG. 1.

In FIGS. 20, 20A and 20B, an improved reduced valve assembly 510 is shown, which provides for an automatic self-closing, final sealing without the need for further adhesives, sonic sealing, hot melts, sealing tape, stitching, or the like. The valve assembly 510 is a tri-partite assembly that is related to the valve assembly 210 as shown in FIGS. 16, 16A, and 17. The valve assembly 510 improves upon the valve assembly 210, and affords particular suitability to closing larger width satchel-type bottom bags.

The valve assembly 510 embodies modifications to the valve assembly 210 by providing folded-over, nested portions of a seal lock 503 and offset plastic layer 505. Further, the seal lock 503 and offset layer 505 have a sufficient lateral dimension, in relation to the width of the bag side 28, whereby to overlap at O and O' to provide a fully peripherally wrapping sleeve-like arrangement around a valve-tube 502.

In the illustrative example, and as in the previous descriptions, the valve bag 20 has a satchel-type bag end 26 having a width of about eight inches, which reflects a common large size satchel-type bag well known in the industry. The seal lock 503 is made of 30–80 pound high performance paper. The offset layer 505 is preferably made of thin polyethylene, preferably thinner than the thickness of the seal lock 503. The outward edge of the seal lock 503, valve tube 502 and bag side 28 are substantially co-terminate, i.e., ending in the same vertical plane, as shown in FIG. 22 and as more specifically described hereinafter. Because the valve assembly 510 is automatically self-closing, the valve tube 502 need not extend bag outwardly and thus offers material cost savings. Of course, the valve assembly 510 would still be automatically self-closing if the valve tube 502 did extend bag-outwardly, but this is a waste of material.

As previously described, the valve bag 20 has long sides 22, 23, a bag end 26, and a valve side 28 where a short side 24 meets the bag end 26. The satchel-like bag end 26 is formed by folded longer flaps 32, 34 and short side flaps 36, 38. The valve assembly 510 is generally associated with the bag end 26 in the same manner as shown for the valve assembly 210 in FIGS. 16 and 17, however the valve tube 502 is narrower, the seal lock 503 and offset layer 505 are nested in folds and overlapped to make a sleeve, and the valve tube 502 is shortened to terminate at the outward side of the seal lock 503. As shown in FIG. 16, the seal tab lock 203 is not folded upon itself and does not overlap. Likewise the offset layer 205 is not folded over itself and is not overlapping. The seal lock 503 includes tab locks 503*a*, 503*b*, 503*g* and 503*h*. A folded over portion 505*e* makes the tab locks 503*g* and 503*h* to be double-layered and form a pocket for the offset layer 505, as will be understood in connection with FIG. 20B. The seal lock 503 includes an inner edge 503*c*, an outer edge 503*d*, and another inner edge 503*f* created by the folding of folded portion 503*e*. The tab locks 503*a*, 503*b*, 503*g* and 503*h* have sufficient width whereby to overlap when folded around fold lines F and FF to provide the overlap O, which in the illustrated embodiment is approximately one inch. As in previous embodiments, the fold lines F and FF generally correspond to the fold lines 40 of the bag end 26. Thus, the dimensions L shown to the sides of the fold lines F and FF would add to equal the width of the bag end 26 plus two inches in the disclosed embodiment.

The formation of the folded portion 505*e* of the seal lock 505 provides a pocket-like configuration for the retention or capture of a portion of the offset layer 505. The offset layer 505 includes opposing tab locks 505*a* and 505*b*, and further has an inner edge 505*c* and an outer edge 505*d*. A folded portion 505*e* corresponds to, but is not as long as, the folded portion 503*e*. The folded portion 505*e* extends bag inwardly from the outside edge 505*d* and forms tab locks 505*g* and 505*h*, which are folded in the same direction as the tab locks 505*g* and 505*h*. The tab locks 505*g* and 505*h* are nested within the pocket-like folded configuration of said portion 503*e*. In the disclosed embodiment, the folded portion 503*e* is approximately twice the length of the folded portion 505*e*. An inner or leading edge 503*f* of the seal lock 503 thereby projects farther bag-inwardly than an inner leading edge 505*f* of the offset layer 505, however stopping short of projecting to an inner opening 506 of the valve tube 502, best viewed in FIG. 20B. As with the seal lock 503, the offset layer 505 has a sufficient lateral dimension allowing the tab locks 505*a*, 505*b*, 505*g* and 505*h* to provide an overlap O' of approximately one inch, as shown in FIG. 20A. Along the overlaps O and O', the seal lock 503 and offset layer 505 are adhered together during the making of the bag 20, preferably by use of a hot melt, thereby trapping the offset layer 505 within the folded portion 503*e*. In order to secure the offset layer 505 and to prevent it from shifting, because it is preferably made of a thin plastic film that can shift, the offset layer 505 is laterally stepped, or shifted, to displace its outside later edge 505*i* a short distance from an outside edge 503*i* of the seal lock 503, also as best viewed in FIG. 20B. In the disclosed embodiment, the shifting shown at S is about one-quarter inch. It generally would fall in the range of from about 1/16 to 3/8 inches. This shift, or stepping S, thereby provides a small stepped-out part of the offset layer 505 relative to the seal lock 503 to allow the adhesive to come into contact with both the seal lock 503 and the offset layer 505 along the overlaps O and O'. The stepping S could either be in either lateral direction, i.e. leftward or rightward depending upon whether the tab locks 503*a*, 503*g* overlap 503*b*, 503*h* or vice versa. As shown in FIG. 20A, the tab locks 503*a* and 503*g* overlap tab locks 503*b* and 503*h* accordingly, the shifting S is shown in the rightward direction of the arrow for step S in FIG. 20B. Due to the overlaps O and O', there is no gap between the tab locks 503*a*, 503*g* and 503*b*, 503*h* of the seal lock 503, or between the tab locks 505*a*, 505*g* and 505*b*, 505*h* of the offset layer 505 contrary to the relationships of the tab locks shown for seal tab lock 203 and offset layer 205 of the embodiment for valve assembly 210. The valve assembly 210 leaves a gap across the top of the valve tube 202.

The valve assembly 510 provides a two-layer flap valve 509 and single layer flap valve 519, the later of which is created by the inward offsetting of the seal lock 503 and offset layer 505 from the inner opening 506 of the valve tube 502. Specifically, in reference to FIG. 20B, it would be understood that product filling inside the valve bag 20 will push upward against both the seal lock 503 and offset layer 505 at the flap valve 509 and press against both of these layers. However, from the inner edge 503*c* of the seal lock 503 to the inner edge of 505*c* of the offset layer 505, at the flap valve 519, only the thin plastic offset layer 505 would be pushed and compressed upwardly by the product. Thus, at the flap valve 509, the portions of the seal lock 503 and offset layer 505 above and below the valve tube 502 are both pressed together. Inwardly of the inner edge 503*c* of the seal lock 503, at the flap valve 519, only the portions of the offset layer 505 above and below the valve tube 502 would be pressed together in a sealingly tight relationship. In further achievement of this sealing closure, the pocket-like portions formed by the folded portions 503*e* and 505*e* will be observed to form a trapping double collar encircling the valve tube 502 in order to further prevent sifting of material between the valve assembly 510 and the paper plies of the bag end 26 and also along gaps G and GG formed between the valve tube sides 507 and 508 and fold lines F and FF, respectively, as shown in FIGS. 20 and 20B. These folded portions 503*e* and 505*e* create a peripheral trap for catching particles and comminuted or granulated materials seeking to otherwise sift and leak outwardly of the bag during filling.

In the illustrative embodiment, the width of the valve tube 502 is slightly less than two-thirds of the width of the bag end 26. Accordingly, in the disclosed embodiment, the gaps G and GG are approximately one and one-half inches each. The valve tube 502 has a width in the range of from about 50% to 80% of the width of the bag end 26.

The valve tube 502 has an outer opening, or outer end 511, which is coterminous with the outward edge 503*d* and valve side 28 of the valve bag 20. The valve tube 502 has an inner opening 506 through which the product is passed into the bag interior. In the disclosed embodiment the length of the valve tube 502 between the outer opening 511 and inner opening 506 is substantially the same as the distance between the outer edge 503*d* and inner edge 503*c* of the seal lock 503, herein is about four and one-half inches. The offset layer 505 extends bag inwardly of the edge 503*c* approximately three and three-quarter inches, but this dimension may vary, as long as the flap valve 519 has sufficient surface area to provide effective sealing closure bag inwardly of the inner edge 503*c* of the seal lock 503.

The valve tube 502, like the valve tube 202 of the valve assembly 210, includes an inner surface 501. However, the inner surface 501 need not be provided with any sealable coating, because a sonic or other final sealing is not required for the valve assembly 510. The valve tube 502 also has a valve channel 504 extending between the outward opening 511 and inner opening 506 into which a filling nozzle, such as nozzle 80 shown in FIG. 10, may be inserted for injecting product into the valve bag 20.

Similar to the assembly of the valve assembly 210 with the bag valve 20 shown in FIGS. 17 and 18, the assembly of the valve assembly 510 with the valve bag 20 is achieved by placing the seal lock 503, having pocketed at its portion 503*e* the folded portion 505*e* of the offset layer 505, onto the unfolded satchel bottom 26 of the valve bag 20. Thereafter, the valve tube 502 is similarly placed and glued onto the folded-together seal lock 503 and offset layer 505, as shown in FIG. 20B. The seal lock 503 and offset layer 505 are then folded around the fold lines F and FF with the bag flaps along fold lines 40, whereupon starch based adhesive, or the like, adheres the valve bag 20 to the valve assembly 510.

As a result, the valve assembly 510 provides a tri-partite arrangement of a valve tube 502, seal lock 503 and offset layer 505 providing a reduced valve tube width and an automatically self-closing valve with no outward extension, thereby eliminating a final sealing. The valve bag 20 requires no further mechanical closure or sealing step on the production line. Accordingly, the utilization of the valve assembly 510 for the larger size satchel-bottom bag satisfies the needs of the industry for filling such type bags with comminuted fine, granular materials without leakage or sifting.

While specific embodiments of the present invention have been shown here for the purposes of explaining preferred and alternate embodiments of the inventions, it is to be understood that the appended claims have a wide range of equivalents and a broader scope than the embodiments disclosed.

What is claimed is:

1. A valve bag assembly comprising:

a tubular bag body having a satchel-type bag end being a valve end having a valve side, an interior portion and an exterior surface, said valve side including an opening at said valve end for accommodation therein of a valve; and, a valve having:

a valve tube disposed within the said opening of said valve side of the valve end and having a width smaller than said opening, the valve tube further having an inner opening, an outer opening, an interior surface and an exterior surface, the inner opening extending into the interior portion of said tubular bag body and the outer opening being substantially coterminous with the opening of said valve side of the tubular bag body, the outer opening being open outwardly of the exterior surface of said tubular bag body, said valve tube providing a channel through said opening of the valve side for passage into the interior portion of said valve bag for filling the bag and the valve tube being freely closeable upon filling the bag; and flap valve members having a seal lock layer and an offset layer, both layers having an inner edge, an outer edge and oppositely folding tab locks, the inner edge of said offset layer extends past the inner edge of said seal lock layer, said outer edges formed by folding said seal lock and offset layers to nest together thereat and form a bag-inward trapping collar to prevent product leaking around the valve tube, said outer edges being substantially coterminous with the outer opening of said valve tube, the seal lock and offset layers being disposed at said valve side with the tubular bag body opening and around the exterior surface of the said valve tube, the inner edge of said offset layer extending past the inner opening of said valve tube, said tab locks of both said seal lock and offset layers being folded over the valve tube a sufficient distance overlap forming a sleeve-like configuration, whereby said seal lock and offset layers accommodate the valve tube within the sleeve-like configuration, said sleeve-like configuration having a width substantially the same as the width of the opening of said valve side, said seal lock and offset layers forming flap valves at said satchel-type bag end for closing the bag-inward opening of the valve tube, thereby creating a flap valve closure action, which effects an automatic non-adhesively self-closing valve tube closure by sealing around and closing the valve tube and the opening of the valve side of the tubular bag body and forming a barrier to outward channeling of the bag contents through and around the valve tube during and after bag filling.

2. The valve bag assembly according to claim 1 wherein said inner edge of said seal lock layer is substantially coterminous with the inner opening of the valve tube.

3. The valve bag assembly according to claim 1 wherein the width of the sleeve-like configuration creates gaps to the sides of the valve tube.

4. The valve bag assembly according to claim 1 wherein the valve assembly provides a non-mechanical automatic self-closure upon the filling of the interior portion of the tubular bag body.

5. The valve bag assembly according to claim 1 wherein the oppositely folding tab locks are bonded together along said overlap.

6. The valve bag assembly according to claim 1 wherein the width of the valve tube is in the range from about 50%–80% of the width of the opening at the valve side of the tubular bag body.

7. The valve bag assembly according to claim 1, wherein said valve tube is made of natural kraft paper.

8. The valve bag assembly according to claim 7, wherein the weight range of said natural kraft paper is from about 60 to 70 pounds.

9. The valve bag assembly according to claim 1, wherein the oppositely folding tab locks overlap by at least about one inch.

10. The valve bag assembly according to claim 1, wherein the valve end is a satchel-type bag end having a width of from about six inches to about nine inches.

11. The valve bag assembly according to claim 1, wherein the inner edge of said offset layer extends bag inwardly past the inner opening of the valve tube by at least one inch.

12. The valve bag assembly according to claim 1, wherein the valve side of the bag end includes an outer folded edge and an innermost edge of a bag flap, and the distance between the inner edge of said offset layer and the outer edge of said seal lock layer equals the distance between the outer folded edge of the bag and the closest edge of an opening of a fill spout insertable into said valve tube for filling the bag with product.

13. The valve bag assembly according to claim 1, wherein said offset layer is made of thin plastic film.

14. The valve bag assembly according to claim 1, wherein said film is polyethylene.

15. The valve bag assembly according to claim 1 wherein the offset layer is shifted relative to said seal lock layer whereby at least one tab lock of the offset layer contacts at least one tab lock of the seal lock layer.

* * * * *